United States Patent [19]

Conrad

[11] 4,226,202

[45] Oct. 7, 1980

[54] FLOATING LASH BARGE LIFTING DEVICE

[76] Inventor: Edward G. Conrad, P.O. Box 133, Marrero, La. 70073

[21] Appl. No.: 854,493

[22] Filed: Nov. 23, 1977

[51] Int. Cl.[2] ..... B63C 1/02

[52] U.S. Cl. ..... 114/48; 405/4; 114/263

[58] Field of Search ..... 61/65; 187/8.59; 114/44–49, 77 R, 77 A, 263; 405/3, 4, 5, 6, 7

[56] References Cited

U.S. PATENT DOCUMENTS

| | | | |
|---|---|---|---|
| 1,264,257 | 4/1918 | Beckwith | 114/49 |
| 1,571,178 | 2/1926 | Donovan | 187/8.59 |
| 2,932,271 | 4/1960 | Crandall | 114/46 |
| 3,007,316 | 11/1961 | Higgins | 61/65 |
| 3,065,721 | 11/1962 | Roudabush | 114/263 |
| 3,265,024 | 9/1966 | Kramlich | 61/65 |
| 3,276,211 | 10/1966 | Drake | 114/48 |

FOREIGN PATENT DOCUMENTS

| | | | |
|---|---|---|---|
| 296655 | 5/1928 | Fed. Rep. of Germany | 114/48 |

*Primary Examiner*—Trygve M. Blix
*Assistant Examiner*—D. W. Keen
*Attorney, Agent, or Firm*—Cushman, Darby & Cushman

[57] ABSTRACT

The hull has a pair of laterally spaced pontoons which are rigidly interconnected by beams which extend between them at a level low enough that a barge will float over them. An elevator with a lifting and lowering mechanism is mounted on the hull with sling or cradle-like lifting bars. The lifting bars have upstanding posts which are shaped, sized and spaced to fit in the stacking post sockets conventionally provided in the hull bottoms of LASH barges. In a lower condition of the elevator, a barge will float over the bars. In a raised condition of the elevator, workers may stand on the hull pontoon decks and work on the sides of the barge and work on the bottom of the barge from scaffolding hanging under the lifting bars. For working on conventional river barges (which are longer than LASH barges) the lifting devices may be used in pairs.

19 Claims, 8 Drawing Figures

FLOATING LASH BARGE LIFTING DEVICE

BACKGROUND OF THE INVENTION

Although the present inventor is unaware of any portable, floating lifting devices for LASH barges such as the one he has invented, there are three other sorts of devices in use that have sufficient similarities as to bear discussion. These are floating drydocks, marina boat lifts, and sunken hull salvaging devices.

Floating drydocks, in general, have a cradle-like hollow hull that has floodable compartments. When the compartments are flooded, the vessel to be worked on is sailed into the cradle. Then the flooded compartments are pumped out to raise the whole drydock/vessel combination sufficiently that the vessel is out of the water or is raised sufficiently to be worked on. Generally the distance between cradle sides is somewhat greater than the vessel. In the spaces between the cradle sides and the vessel hull sides the workers have access to the vessel hull sides. See FIG. 1. But that working quarters often is cramped, some ordinary tasks are made difficult and some jobs are hard to do well at all.

With these floating drydocks, usually a blanket of wood is necessary as an interface between the vessel hull bottom and the dock surface on which the vessel hull is supported. When the wood blanket is in the form of loose blocks or beams, it is difficult to get all of them in just the right positions when the dock flotation compartments are to be pumped out to raise the vessel. And, often, the wood blanket gets all roughed-up so it needs replacement when a next vessel is going to be worked on. Notice also from FIG. 1 how difficult it must be to work on the vessel hull bottom when it is so near the water and so obstructed.

The floodable compartments of conventional floating drydocks extend laterally so as to be under the vessel to provide sufficient hollow space to accomplish the rising and sinking. The difference in buoyancy between these compartments is difficult to control during rising and sinking, especially when the drydock hull being flooded, or pumped also is being subjected to river currents. As a consequence, usually drydocks are confined to use at a single protected site. The ships to be worked on must be brought to the drydock site. Thus while a conventional floating drydock floats, it usually is moored at a site and is not "portable" in the sense that it cannot "make house-calls" on vessels in need of repair.

The following prior U.S. patents show drydocks:

Janicki, No. 126,146, issued Apr. 30, 1872; Drake, No. 3,276,211, issued Oct. 4, 1966.

Boat lifts, e.g, for very light vessels such as small sail boats and pleasure craft are shown in the prior U.S. patent of Kramlich, No. 3,265,024, issued Aug. 9, 1977.

In lifting sunken hulls, conventionally, slings are passed under the sunken hull and secured on the opposite sides to pontoons. The vessel hull is and/or the pontoons are pumped out and the slings are raised to raise the hull. A prior art sunken hull salvage device is shown in the prior U.S. patent of Gowen, No. 110,564, issued Dec. 27, 1870.

Others previously have provided hull-supporting cradles with interfacing surfaces shaped to fit at least some part of the hull they are supporting. The prior U.S. patent of Beale, No. 3,777,691, issued Dec. 11, 1973 provides an example.

A mechanical lifting device, but one using screw shafts and worm screws, for lifting a vessel, is shown in the prior U.S. patent of Turner, No. 47,501, issued Apr. 25, 1865.

SUMMARY OF THE INVENTION

The hull has a pair of laterally spaced pontoons which are rigidly interconnected by beams which extend between them at a level low enough that a barge will float over them. An elevator with a lifting and lowering mechanism is mounted on the hull with sling or cradle-like lifting bars. The lifting bars have upstanding posts which are shaped, sized and spaced to fit in the stacking post sockets conventionally provided in the hull bottoms of LASH barges. In a lower condition of the elevator, a barge will float over the bars. In a raised condition of the elevator, workers may stand on the hull pontoon decks and work on the sides of the barge and work on the bottom of the barge from scaffolding hanging under the lifting bars. For working on conventional river barges (which are longer than LASH barges) the lifting devices may be used in pairs.

Electric, electric-hydraulic, hydraulic, screw or other mechanical means may be used to power the elevator.

Preferably the lifting bars are not flooded and pumped out, but are beams which can be raised and lowered without causing the whole device to tip excessively, either in still water or in a river current.

The principles of the invention will be further discussed with reference to the drawings wherein (a) preferred embodiments is shown. The specifics illustrated in the drawings are intended to exemplify, rather than limit, aspects of the invention as defined in the claim.

DETAILED DESCRIPTION

Figure 1:
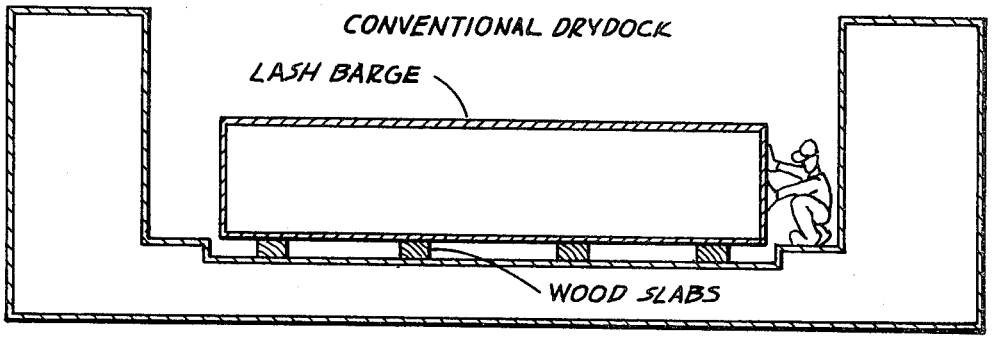
FIG. 1 is a diagrammatic transverse sectional view of a conventional floating drydock with a vessel lifted and supported thereby.

The floating LASH barge lifting device 10 includes a buoyant hull 12 provided with an elevator 14 with lifting and lowering means 16 for raising and lowering the elevator carriage 18.

The buoyant hull is in the form of two longitudinally extending, laterally spaced hollow hull portions, e.g., pontoons 20 rigidly laterally interconnected by a plurality of transversally extending, longitudinally spaced beams 22. Two are shown. These pass between submerged sites on the pontoons 20 at such a low level that a LASH barge being inserted in or withdrawn from the device passes over and does not encounter the beams 22.

The beams 22 may also be hollow and in such case may be interconnected with or isolated from the hollow interiors of the pontoons 20. The pontoon shape shown is the one presently preferred. When the elevator is fully lowered and no barge is supported on the carriage, the device 10 floats submerged to the level LE indicated in FIG. 2. Upon raising and supporting a standard LASH barge of conventional size and weight where this usually is done (e.g., at the mouth of the Mississippi River), the device 10 floats submerged to the level LF, also indicated on FIG. 2.

The elevator 14 is shown including four vertically extending guide rods 24, each one rigidly mounted by brackets 26 so it is disposed just forwardly of or just aft of a respective end of a respective pontoon 20.

A first, horizontally, transversally extending lift bar 28 is provided with a vertically oriented tubular sleeve 30 at each end thereof. Two transversally spaced ones of the rods 24 are slidingly "journalled" in the respective sleeves. The second, horizontally, transversally extending lift bar 32 with sleeves 30 is likewise slidingly mounted on the other two transversally spaced ones of the rods 24.

For each sleeve 30 there is shown provided on the respective adjacent pontoon end a winch drum 34. At each drum 34, a respective inextensible flexible element such as a wire rope, cable or chain has its one end secured to the drum and its other end 36 secured to a wing flange 38 on the respective sleeve 30. The drums 34 are powered to be rotated in unison, or in a coordinated manner, so that the bars 28 and 32 are each raised and lowered by the same amount at each end. There are many conventional available motive means for doing that using different sorts of power transmission media (pneumatic fluid, hydraulic fluid, electrical, electro-hydraulic, mechanical, etc.), so a suitable such means is generally indicated at 39.

The elevator shown is presently preferred, but one among others which could be used.

The elevator carriage bars 28 and 32 are shown provided with four upstanding posts 40 which are shaped, sized and spaced to fit in the four corresponding stacking post sockets 42 normally provided in the hull bottoms of LASH barges. Thus, these posts 40 have tapered upper ends 44.

Figure 7:
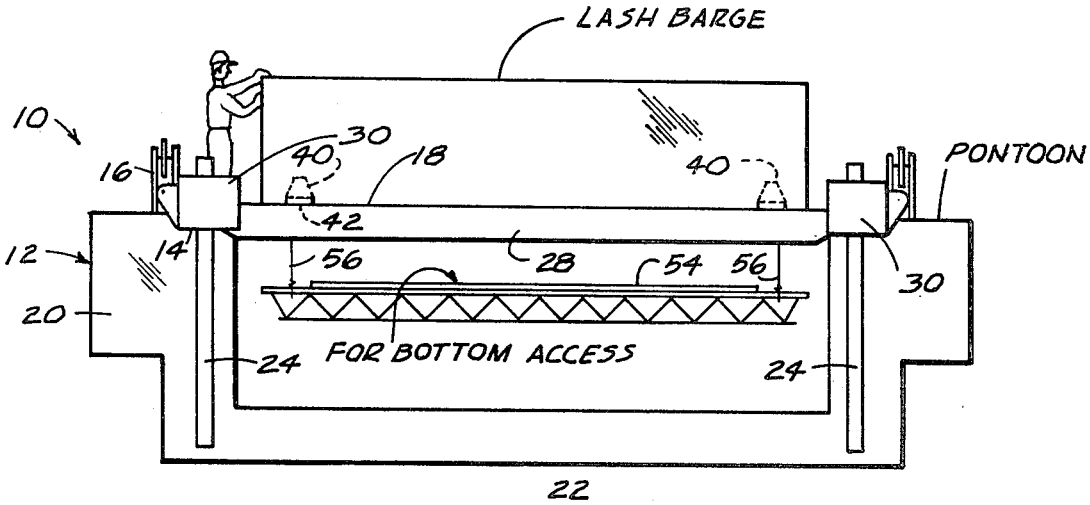
FIG. 7 is a diagrammatic end view of the device of the present invention in use, for comparison with FIG. 1.
Figure 2:
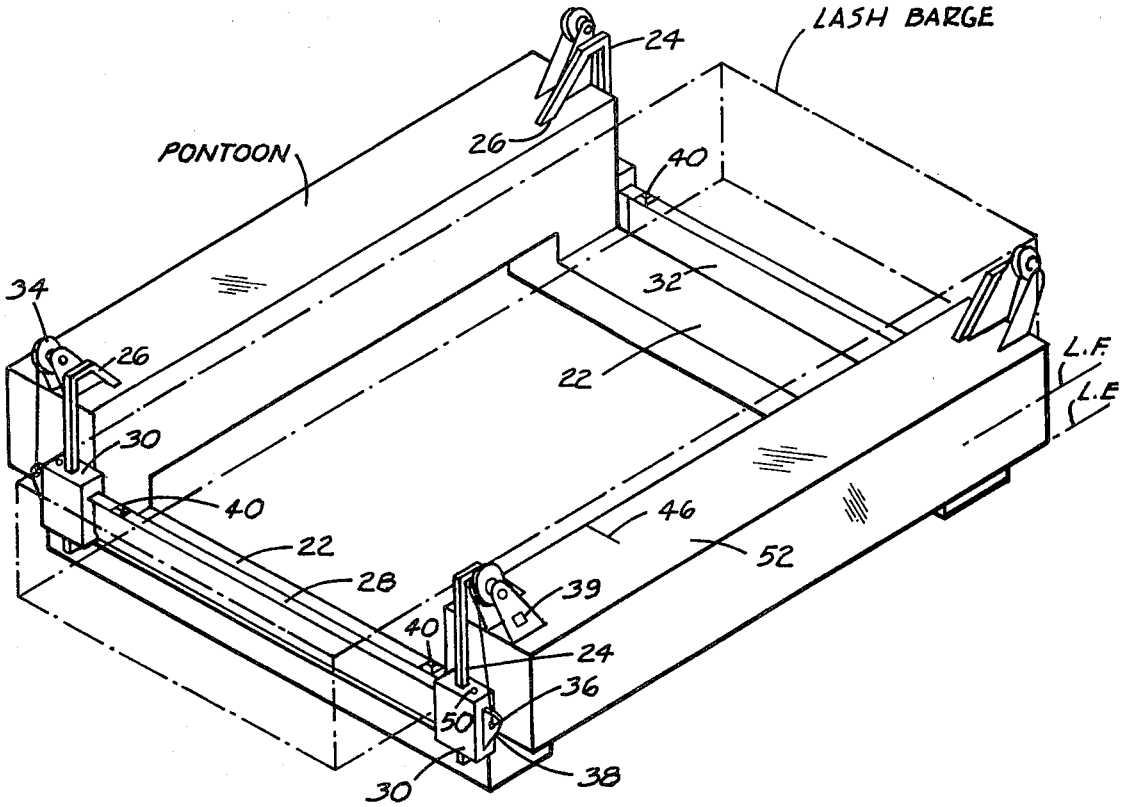
FIG. 2 is a perspective view of a preferred embodiment of the floating LASH barge lifting device, with the elevator thereof in a fully lowered condition.
Figure 5:
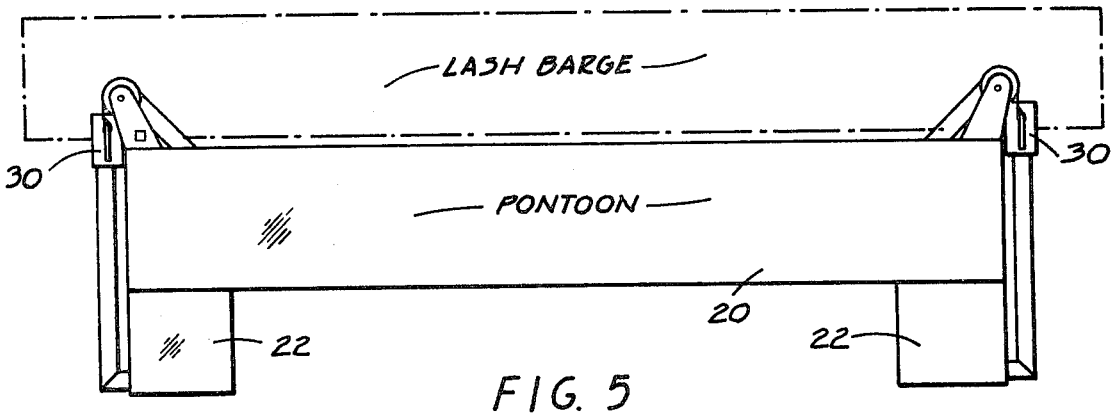
FIG. 5 is a side elevation view of the device with its elevator in a fully raised condition, the disposition of a LASH barge in relation thereto being suggested in phantom lines.
Figure 6:
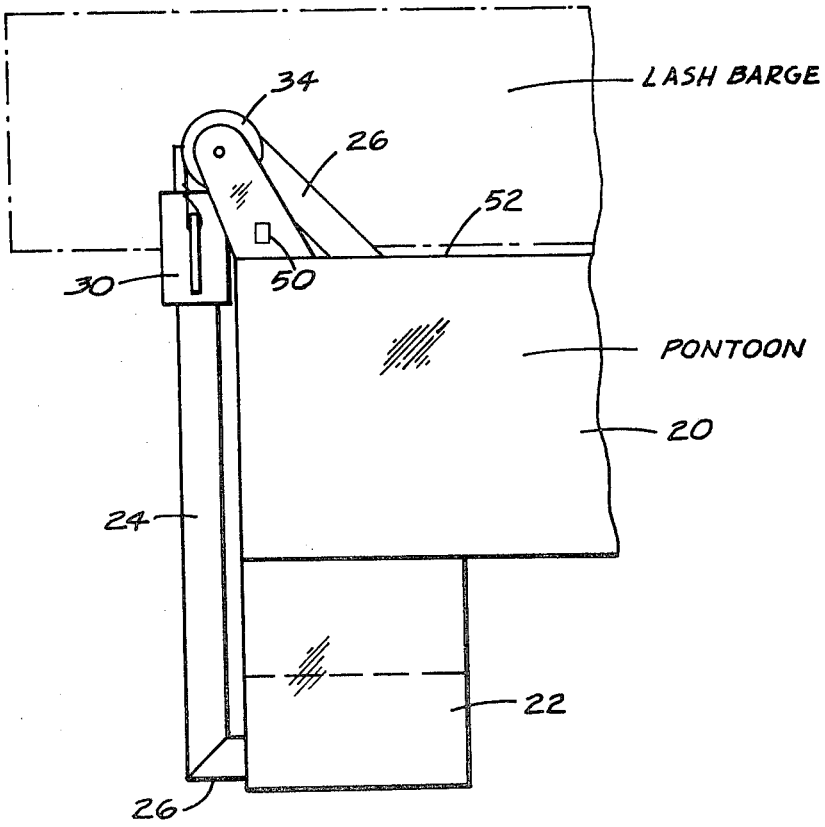
FIG. 6 is an enlarged detail from FIG. 5.

The magnitude and relative extent of travel of the bars 28, 32 between their fully lowered condition and their fully raised condition may be seen by comparing FIG. 2 with FIGS. 5, 6 and 7.

When the elevator is fully lowered the bars 28, 32, even the post ends 44 are spaced comfortably below the normal level of the hull bottom of a floating LASH barge. Thus, a floating LASH barge may be floated into position for being raised on the device 10, and floated out again, both when the elevator 14 is fully lowered.

Preferably, one or more mechanical jigs 46 is provided on the device 10. The crew is advised how a floating LASH barge that is to be lifted by the device 10 appears in juxtaposition with the jig means 46 at a time when the four LASH barge stacking post sockets substantially perfectly overly the four respective upstanding post ends 44 on the elevator carriage bars 26, 32. From then on, lining up the barge with the device is an easy matter.

As the motive means 39 is operated, the bars 28 and 32 begin to lift under the LASH barge hull. The posts 40 home in the sockets 42 and the LASH barge is lifted so much as is necessary to give convenient access to the portions which are to receive repair.

Preferably, as shown, the elevator 14 is provided with a suitable mechanical lock 50, e.g., between the rods 24 and sleeves 30 (or, e.g., on the drums 34), which can be engaged when the LASH barge has been raised sufficiently, so one need not rely on the lifting and lowering means 16 for maintaining the elevated disposition of the elevator and barge.

Referring to FIG. 6, preferably, the LASH barge may be lifted so much that the LASH barge hull sides are fully above the level of the deck 52 of the pontoons. The bottom of the hull may be worked on from underneath. Conveniently, a work platform, plate or similar scaffolding 54 may be hung from the lifting bars 28, 32 via perimetrical suspension chains 56. When the elevator is lowered, the scaffolding 54 may rest on the cross beams 22 of the hull 12 of the device 10.

The device 10 may, of course, have accessories. It may be self-propelled or be designed to be towed or pushed. Thus it may include propulsion power means, navigational apparatus, anchoring and station-keeping devices and the like. Typically, the hull is fabricated of steel plate and trusses, and the elevator bars of steel I-beams, (e.g, size W24X130).

A conventional LASH barge measures 61 feet by 31 feet, with the stacking post sockets located at the corners of an imaginary 52'0"×29'2" rectangle. The space between the bars 28, 32 is typically about 51 feet long, so about four and a half feet of a typical LASH barge will overhang each end of the device 10. (The device 10 is substantially symmetrical end for end and side for side, facilitating its construction.)

Figure 8:
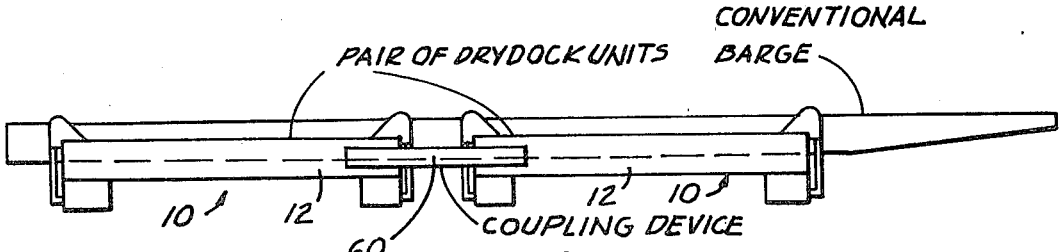
FIG. 8 shows side elevation, and diagrammatically, use of two of the devices, in tandem, for lifting a conventional river barge.
Figure 3:
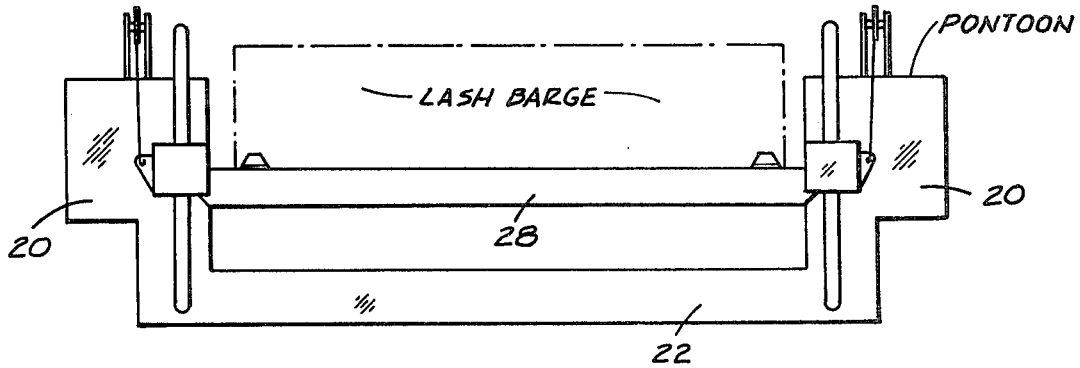
FIG. 3 is a front elevation view of the device with its elevator in a partially raised condition, the disposition of a LASH barge in relation thereto being suggested in phantom lines.
Figure 4:
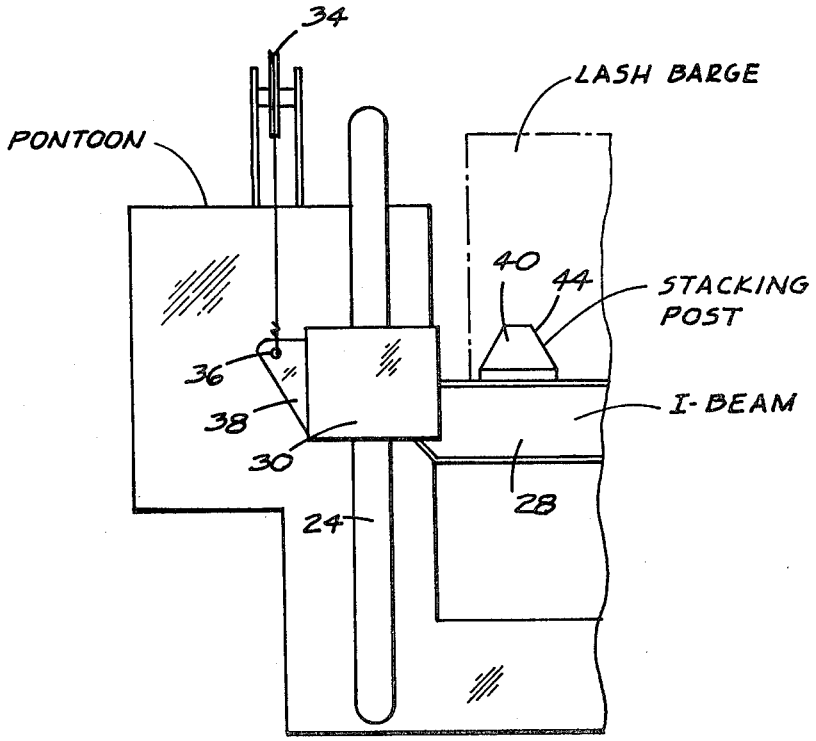
FIG. 4 is an enlarged detail from FIG. 3.

Conventional river barges are substantially longer than conventional LASH barges. A typical conventional Mississippi River barge measures 195 feet×35 feet. For lifting such barges, two of the devices 10 may be used in tandem as shown in FIG. 8. (An overhang of 71.5 feet beyond each end of one device 10 would be too much for its stability and too much stress for the hull structure of the river barge).

In such an instance, the hulls 12 of the two devices 10 are made longitudinally rigid relative to one another using longitudinally extending braces 60 secured to each hull 12 out of the way of the river barge. The control devices 39 for the elevators for the two devices 10 then are physically or functionally juxtaposed for operation coordinately or in unison. If the river barge has no sockets or the like, for receiving the posts 40, the posts 40 can be removed. In other respects, the duplexed device is operated as twins of the device described with reference to FIGS. 2–7.

It should now be apparent that the floating LASH barge lifting device as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A floating lifting device for a floating LASH barge, which as a hull with sides and a bottom, said device comprising:

(a) a hull including:

(i) a pair of longitudinally extending, laterally spaced buoyant hull members, (ii) cross-beam means rigidly interconnecting the two buoyant hull members below where the cross-beams would interfere with ingress to and egress by the floating vessel from where the floating vessel is when it is lifted;

(b) a carriage configured to support the floating LASH barge from the bottom thereof being provided on the hull of said floating lifting device;

(c) a set of four upstanding posts mounted on the carriage (a) in a rectangular array which is congruent with the array of stacking post sockets conventionally provided on the hull bottoms of LASH barges;

(d) an elevating means interposed between the carriage (b) and the hull (a) and being configured to raise and lower, and support the carriage (b) upon the hull (a), between (i) a fully lowered condition in which the carriage (b) is so low relative to the hull (a) that, although the floating lifting device is riding high because it is not weighted down with supporting an object floating vessel, an object floating vessel may be brought thereover without interference therewith to and from where the floating vessel is when it is lifted, and (ii) a fully raised condition in which the carriage (b) is so high relative to the hull (a) that, although the floating lifting device is riding low because it is supporting the object vessel which had been floating, the object vessel is raised sufficiently to permit above board access for repair to such portion of said object vessel as may be in need thereof.

2. The floating lifting device of claim 1, wherein: the two buoyant hull members are pontoons.

3. The floating lifting device of claim 2, wherein: the pontoons are in a sealed condition and not flooded or pumped out to provide said elevating means.

4. The floating lifting device of claim 2, wherein: the cross-beams are respective hollow box beams.

5. The floating lifting device of claim 4, wherein: both the pontoons and hollow box beams are in a sealed condition and not flooded or pumped out to provide said elevating means.

6. The floating lifting device of claim 1, wherein: the carriage (b) comprises:

(i) at least two longitudinally spaced, laterally extensive support bars; and (ii) means engaging and cooperating between the hull (a) and said support bars for guiding the support bars as the support bars move up and down between the raised and lowered conditions.

7. The floating lifting device of claim 6, wherein: each support bar is constituted by an I-beam.

8. The floating lifting device of claim 6, further including:

a lock releasably interposed between the hull (a) and the carriage (b) for maintaining at least one attained selected elevation for the carriage (b) without need for active maintenance of such selective elevation by said elevating means (c).

9. The floating lifting device of claim 1, further including:

a work platform;

suspension means secured to the work platform at a plurality of widely perimetrical sites and extending therefrom to said carriage for slinging said work platform a uniform distance below the hull bottom of the object vessel when the carriage is raised.

10. The floating lifting device of claim 1, wherein: said carriage (b) when in said fully raised condition (ii) is so high relative to the hull (a) that the hull sides of the object vessel may be addressed essentially laterally by workers standing upon the buoyant hull members.

11. A floating lifting device for a floating vessel, such as a LASH barge, which has a hull with sides and a bottom, said device comprising:

(a) a hull including:

(i) a pair of longitudinally extending, laterally spaced buoyant hull members, (ii) cross-beam means rigidly interconnecting the two buoyant hull members below where the cross-beams would interfere with ingress to and egress by the floating vessel from where the floating vessel is when it is lifted;

(b) a carriage configured to support the floating vessel from the bottom thereof being provided on the hull of said floating lifting device;

(c) an elevating means interposed between the carriage (b) and the hull (a) and being configured to raise and lower, and support the carriage (b) upon the hull (a), between (i) a fully lowered condition in which the carriage (b) is so low relative to the hull (a) that, although the floating lifting device is riding high because it is not weighted down with supporting an object floating vessel, an object floating vessel may be brought thereover without interference therewith to and from where the floating vessel is when it is lifted, and (ii) a fully raised condition in which the carriage (b) is so high relative to the hull (a) that, although the floating lifting device is riding low because it is supporting the object vessel which had been floating, the object vessel is raised sufficiently to permit above board access for repair to such portion of said object vessel as may be in need thereof;

the carriage (b) comprising:

(i) at least two longitudinally spaced, laterally extensive support bars; and (ii) means engaging and cooperating between the hull (a) and said support bars for guiding the support bars as the support bars move up and down between the raised and lowered conditions;

the engaging and cooperating means (ii) of the carriage (b) including: four rods; brackets mounting the four rods on the hull (a) in a widely disbursed rectangular array, with each such rod held thereby so as to have a vertical orientation, and a fitting at each end of each support bar, each such fitting being engaged and cooperating with a corresponding one of said rods so that as the elevating means (c) is operated, the respective fittings correspondingly move up and down the respective rods.

12. The floating lifting device of claim 11, further including:

a lock releasably interposed between the respective rods and fittings for maintaining at least one attained selected elevation for the carriage (b) without need for active maintenance of such selective elevation by said elevating means (c).

13. The floating lifting device of claim 11, wherein:

the elevating means (c) includes:

(i) winch means mounted on the hull (a);

(ii) a plurality of perimetrically widely distributed connectors provided on the carriage (b);

(iii) elongated, inextensible, flexible elements having respective one ends secured to said winch means, respective intermediate portions having partly entrained about the winch means and having respective opposite ends secured to respective ones of said widely distributed connectors; and (iv) motive means for operating said winch means to wrap and unwrap corresponding amounts of said elongated, inextensible, flexible elements thereabout.

14. The floating lifting device of claim 13, wherein:

the winch means is constituted by an individual winch for each elongated, inextensible, flexible element, each winch of such four being mounted on the hull adjacent a different respective buoyant hull member end.

15. The floating lifting device of claim 11, wherein:

said carriage (b) when in said fully raised condition (ii) is so high relative to the hull (a) that the hull sides of the object vessel may be addressed essentially laterally by workers standing upon the pontoons.

16. A floating lifting device for a floating vessel, such as a LASH barge, which has a hull with sides and a bottom, said device comprising:

(a) a hull including:

(i) a pair of longitudinally extending, laterally spaced buoyant hull members each having a work station thereon having a support surface means arranged for permitting at least one worker to stand thereon while working on a floating vessel, (ii) cross-beam means rigidly interconnecting the two buoyant hull members below where the cross-beams would interfere with ingress to and egress by the floating vessel from where the floating vessel is when it is lifted;

(b) a carriage configured to support the floating vessel from the bottom thereof being provided on the hull of said floating lifting device;

(c) an elevating means interposed between the carriage (b) and the hull (a) and being configured to raise and lower, and support the carriage (b) upon the hull (a), between (i) a fully lowered condition in which the carriage (b) is so low relative to the hull (a) that, although the floating lifting device is riding high because it is not weighted down with supporting an object floating vessel, an object floating vessel may be brought thereover without interference therewith to and from where the floating vessel is when it is lifted, and (ii) a fully raised condition in which the carriage (b) is so high relative to the hull (a) that, although the floating lifting device is riding low because it is supporting the object vessel which had been floating, the object vessel is raised sufficiently to permit above board access for repair to such portion of said object vessel as may be in need thereof;

the carriage (b) comprising:

(i) at least two longitudinally spaced, laterally extensive support bars; and (ii) means engaging and cooperating between the hull (a) and said support bars for guiding the support bars as the support bars move up and down between the raised and lowered conditions;

said support bars, when said carriage (b) is in a fully raised condition have means defining upwardly facing support surfaces thereon for engaging the object vessel hull bottom and maintaining said bottom disposed at least as high as said upwardly facing support surfaces of said work stations for workers upon the buoyant hull members;

the engaging and cooperating means (ii) of the carriage (b) including: four rods; brackets mounting the four rods on the hull (a) in a widely disbursed rectangular array, with each such rod held thereby so as to have a vertical orientation; and a fitting at each end of each support bar, each such fitting being engaged with and cooperating with a corresponding one of said rods so that as the elevating means (c) is operated, the respective fittings correspondingly move up and down the respective rods.

17. The floating lifting device of claim 16, wherein:

each support bar is constituted by an I-beam.

18. The floating lifting device of claim 16, wherein:

the two buoyant hull members are pontoons.

19. In combination:

a first floating lifting device for a floating vessel, such as a LASH barge, which has a hull with sides and a bottom, said device comprising:

(a) a hull including:

(i) a pair of longitudinally extending, laterally spaced buoyant hull members, (ii) cross-beam means rigidly interconnecting the two buoyant hull members below where the cross-beams would interfere with ingress to and egress by the floating vessel from where the floating vessel is when it is lifted;

(b) a carriage configured to support the floating vessel from the bottom thereof being provided on the hull of said floating lifting device;

(c) an elevating means interposed between the carriage (b) and the hull (a) and being configured to raise and lower, and support the carriage (b) upon the hull (a), between (i) a fully lowered condition in which the carriage (b) is so low relative to the hull (a) that, although the floating lifting device is riding high because it is not weighted down with supporting an object floating vessel, an object floating vessel may be brought thereover without interference therewith to and from where the floating vessel is when it is lifted, and (ii) a fully raised condition in which the carriage (b) is so high relative to the hull (a) that, although the floating lifting device is riding low because it is supporting the object vessel which had been floating, the object vessel is raised sufficiently to permit above board access for repair to such portion of said object vessel as may be in need thereof;

the carriage (b) comprising:

(i) at least two longitudinally spaced, laterally extensive support bars; and (ii) means engaging and cooperating between the hull (a) and said support bars for guiding the support bars as the support bars move up and down between the raised and lowered conditions;

the engaging and cooperating means (ii) of the carriage (b) including: four rods; brackets mounting the four rods on the hull (a) in a widely disbursed rectangular array, with each such rod held thereby so as to have a vertical orientation; and a fitting at each end of each support bar, each such fitting being engaged with and cooperating with a corresponding one of said rods so that as the elevating means (c) is operated, the respective fittings correspondingly move up and down the respective rods;

a duplicate of said first floating lifting device in longitudinal alignment therewith; and brace means rigidly longitudinally interconnecting the two respective hulls (a), so that a substantially longer object vessel may be raised by the two respective carriages (b) operated in a coordinate manner, than either respective carriage (b) could raise were the respective device used alone.

* * * * *